US005855326A

United States Patent [19]

Beliavsky

[11] Patent Number: 5,855,326

[45] Date of Patent: Jan. 5, 1999

[54] PROCESS AND DEVICE FOR CONTROLLED COMINUTION OF MATERIALS IN A WHIRL CHAMBER

[75] Inventor: Yan Beliavsky, Maalot, Israel

[73] Assignee: Super Fine Ltd., Kiryat Shmona, Israel

[21] Appl. No.: 862,372

[22] Filed: May 23, 1997

[51] Int. Cl.[6] ..... B02C 19/06

[52] U.S. Cl. ..... 241/5; 241/39

[58] Field of Search ..... 241/1, 5, 39, 80, 241/301

[56] References Cited

U.S. PATENT DOCUMENTS

| | | | |
|---|---|---|---|
| 2,562,753 | 7/1951 | Trost . | |
| 3,462,086 | 8/1969 | Bertrand et al. . | |
| 3,726,484 | 4/1973 | Schurr . | |
| 3,741,485 | 6/1973 | Gage et al. | 241/39 |
| 3,877,647 | 4/1975 | Gorobets et al. . | |
| 4,176,798 | 12/1979 | Talbott et al. | 241/39 |
| 4,189,102 | 2/1980 | Andrews . | |
| 4,219,164 | 8/1980 | Taylor . | |
| 4,469,283 | 9/1984 | Noguchi et al. . | |
| 4,502,641 | 3/1985 | Coombe . | |
| 4,504,017 | 3/1985 | Andrews | 241/80 |
| 4,505,432 | 3/1985 | Koev et al. . | |
| 4,546,926 | 10/1985 | Niemi . | |
| 4,664,319 | 5/1987 | Andrews . | |
| 5,133,504 | 7/1992 | Smith . | |
| 5,277,369 | 1/1994 | Moriya et al. . | |
| 5,363,599 | 11/1994 | Dischler . | |
| 5,499,770 | 3/1996 | McCullough . | |
| 5,547,135 | 8/1996 | Moriya et al. . | |

FOREIGN PATENT DOCUMENTS

| | | |
|---|---|---|
| 613822 | 6/1978 | U.S.S.R. . |
| 1457995 | 2/1989 | U.S.S.R. . |
| WO 94/08719 | 4/1994 | WIPO . |

*Primary Examiner*—Mark Rosenbaum
*Attorney, Agent, or Firm*—Browdy and Neimark

[57] ABSTRACT

The invention describes a process of controlled comminution of a particulate solid material in to a milling having particles of predetermined dimensions, and also a milling whirl chamber having two end faces and a cylindrical side wall with at least one nozzle for injection a working fluid into the chamber, means for introducing the particulate solid material into the chamber, a central axial passage for discharge of the comminuted material in a flow of the working fluid from the chamber, and one or more mechanical elements for control of the comminution process in the chamber. The process includes tangential injection of the working fluid in to the chamber, introducing the particulate solid material for creating in the chamber a vortex where the particulate material undergoes comminution in the flow of the working fluid, and control of uniformity of the milling and dimensions of the particles therein by deliberately accelerating or retarding discharge from the chamber of the particles moving in the vortex close to the inner walls of the chamber by the mechanical elements provided in the chamber and adapted to interact with such particles.

21 Claims, 11 Drawing Sheets

PROCESS AND DEVICE FOR CONTROLLED COMINUTION OF MATERIALS IN A WHIRL CHAMBER

FIELD OF THE INVENTION

The present invention relates to a technology of fine comminution of particulate solid materials in a whirl (vortex) chamber.

BACKGROUND OF THE INVENTION

In the art under consideration a distinction is made between jet pulverizing systems or jet mills and whirl or vortex chamber mills. In one type of jet mill particles to be comminuted are introduced into the working fluid which is brought up to the high speed in a chamber owing to injecting thereof through one or more Venturi nozzles; moving in the high speed fluid flow, the particles collide with a target which may constitute reflective surfaces and/or other particles moving in different fluid flows in the chamber. In other words, in jet mills the particles are ground owing to the collision effect. Working speeds at which the particles of different materials move and get milled in the fluid flows in jet mills are substantially not less than 150–300 m/s. Such jet mills are described for example in U.S. Pat. No. 5,133,504. In another kind of jet mills the coarse particles are forced to collide with intersecting high speed fluid jets, thus obtaining even a higher resulting speed of interaction, and such technology is described for example in U.S. Pat. No. 4,546,926.

Neither of these kinds of jet mills is pertinent prior art with respect to the new technology being the subject of the present patent application.

It is also known to use whirl or vortex chambers in conjunction with jet mills for the classification of the ground material emerging from jet milling. In such combined system the relatively coarse particles are recirculated from the whirling classifier to the jet mill and such systems are described for example in U.S. Pat. Nos. 4,219,164, 4,189,102 and 4,664,319. It should be emphasized, that in such systems vortex chambers do not effect the milling operation, but rather the sorting.

Moreover, it has already been known to use whirl or vortex chambers for milling.

One modification of this technology is referred to, for example, in U.S. Pat. No. 4,502,641, and still constitutes a combination of the jet milling principle with a vortex chamber. A material to be comminuted is introduced into the vortex chamber through a venturi nozzle, i.e. at a speed of about 300 m/s. On the other hand, in the vortex chamber there is created a fluid flow vortex which rotates at a speed being much lower than the above mentioned value. During operation the particles injected into the chamber earlier become involved in the rotation of the relatively slow fluid vortex and thus turn to targets for the particles which continue to be injected through the venturi nozzle at the high speed. Such interaction results in collision between the particles in the vortex and the particles in the jet, i.e. ensures the comminution owing to the collision principle, as in the jet-mills mentioned above.

There are known milling vortex chambers which perform a so-called resonance whirl milling. Such a milling process differs from the jet milling process by a number of specific conditions, for example, by the speed of particles to be comminuted in the fluid flow, which in whirl chambers is considerably lower than that in jet mills. In these chambers there is no need in the high speed injection (through venturi nozzles) of the particles to be comminuted. Speed of the fluid flow in the nozzles of the vortex chamber is usually in the range of 50–130 m/s, and speed of the particles to be comminuted which move in the rotating fluid flow in the chamber is still lower and not greater than 50 m/s. It should be stressed that at such speeds jet mills turn to be totally useless. Owing to such specific conditions prevailing inside the whirl chamber the relatively coarse fed-in solid particles disintegrate spontaneously rather than in consequence of collision between the particles. It is generally believed that this effect is due to the fact that the coarse particles fed into the chamber, while rotating in the vortex, travel back and forth across the vortex thus passing a series of annular concentric zones with different values of fluid pressure so that in the course of their radial movement the particles are subjected to pressure gradients. In the course of a repeated back-and-forth motion a disbalance of pressure builds up in numerous cracks and cavities of the particles leading to gradual loosening of the particles' structure and eventually to spontaneous disintegration. Owing to this special milling principle the vortex chambers enable to comminute there inside such materials as rubber, paper, etc. i.e. the materials which can not be milled by colliding in jet mills. Moreover, super-hard abrasive materials, such as diamonds and boron nitride (BN), which cannot be milled by impact (collision), appeared to be comminutable in the resonance vortex chambers.

WO 94/08719 and SU 1,457,995 describe whirl chamber milling apparatuses fitted with tangential fluid injection nozzles and performing the so-called "resonance vortex grinding". The milling chamber comprises a generally cylindrical body with one or more openings serving for the introduction of a particulate solid matter to be comminuted. During the milling process, particles reaching dimensions substantially close to the required range of the milling are continuously discharged via an axial discharge duct. There may be further provided one or more sound generators placed each in the nozzle for interacting with the incoming fluid flow and thereby enhancing the grinding operation (WO 94/08719), or the chamber may be provided with a rotatable internal side wall adapted for rotation in the direction opposite to the vortex direction (SU 1,457,995).

It should be emphasized, that in each of the mentioned milling whirl chambers the comminution process, once initiated under specific parameters (such as the dimensions of the chamber, the volumetric flow rate and the viscosity of the working fluid, the size of the particles to be comminuted, etc.), will last until all the comminuted material is unloaded from the discharging passage of the chamber. In other words, between the moment the material is loaded to the milling whirl chamber and the moment it is completely discharged therefrom, the milling chamber acts as a black box.

None of the references known from the prior art deals with improving efficacy of the whirl milling chamber apparatuses, as such. More particularly, no means have been mentioned or described in the prior art for controlling the comminution process in the whirl chambers for deliberate adjusting the degree of comminution and uniformity of the milling which is expected to be obtained.

OBJECT OF THE INVENTION

It is therefore an object of the present invention to provide a controllable process of comminution in vortex chambers and an improved vortex chamber apparatus adapted for effecting a controllable comminution process.

GENERAL DESCRIPTION OF THE INVENTION

According to one aspect of the invention, the above object may be achieved by effecting a process of comminution of a particulate solid material in to a milling having particles of predetermined dimensions to be provided in a substantially cylindrical milling whirl chamber having two end faces and a side wall with at least one nozzle for injection a working fluid into the chamber, means for introducing the particulate solid material into the chamber, and a central axial passage for discharge of the comminuted material in a flow of the working fluid from the chamber, said process comprising:

tangential injection of the working fluid in to the chamber, introducing said particulate solid material into the chamber, thereby creating a vortex of the particulate material in the working fluid where said material undergoes comminution from relatively coarse particles to fine particles having sizes substantially close to the predetermined dimensions, and control of uniformity of the milling and dimensions of the particles therein by deliberately accelerating or retarding discharge from said chamber of the particles moving in the vortex close to the inner walls of the chamber.

It has been found by the inventor, that duration of the comminution process, and therefore, results thereof may be altered by providing a controlled action onto the particles of the material undergoing the milling in the whirl chamber which move in the vortex close to the inner walls of the chamber. Such particles are mostly the relatively coarse ones. By means which will be disclosed later on, the mentioned particles may be deliberately caused either to be prematurely discharged from the chamber (so that a quick though rather non-uniform coarse grinding is obtained), or to be retained in the chamber for a prolonged time for obtaining a fine and more uniform milling.

For example, said control action may be provided by adjusting conditions of viscous friction between the vortex and the inner surface of the end faces of the cylindrical chamber, which may be accomplished by means described later on.

Alternatively, or in addition, the control action may be accomplished by providing a controlled auxiliary discharge of the particles undergoing comminution via at least one additional discharge channel provided in the chamber and being different from said axial passage; a volumetric flow rate taking place through said at least one channel not exceeding 40% of a total volumetric flow rate in the vortex.

According to another aspect of the invention, there is provided a whirl milling chamber for fine comminution of a particulate solid material, the chamber being formed in a housing having a substantially cylindrical shape with two end faces and a side wall provided with one or more tangential nozzles for the injection of a working fluid into the chamber and creating a vortex therein, said chamber comprising means for the introduction there into a particulate solid material to be comminuted, an axially disposed discharge passage provided in one or both said end faces, and control means in the form of one or more mechanical elements adapted to interact, when the vortex is created, with its layers moving close to inner walls of the chamber, thereby enabling for control of the comminution.

According to one embodiment of the invention said mechanical element is an additional discharge channel provided in said housing not in alignment with said axially disposed discharge passage and intended for a premature controlled discharge of the relatively coarse particles moving near the walls of the chamber, thus reducing duration of the comminution process and obtaining a milling characterized by relatively low degrees of comminution and uniformity. The chamber may comprise more than one said discharge channels, fitted each with a control valve. However, the additional discharge channel(s) must be designed so that the maximal volumetric flow rate taking place therethrough does not exceed 40% of a total volumetric flow rate in the vortex.

In the preferred embodiment said at least one additional discharge channel is provided in the side wall of the housing and is fitted with a tangential duct for controllable discharge of the material in the direction opposite to that of the vortex.

Owing to the difference of pressures inside and outside the chamber, the additional channel enables for a controlled discharge of those relatively coarse particles which mostly move in the peripheral layers of the fluid vortex, thereby enabling to adjust results of the comminution process in the whirl chamber. The greater part of the working flow is discharged from the additional channels, the coarser milling is obtained. It can be explained by the fact that those particles which are discharged with the mentioned part of the flow could otherwise stay in the chamber for further comminution. Such a regulation also allows to reduce the energy consumption per kg of the milling mass.

Alternatively, said at least one additional discharge channel may be provided in one of the end faces of the chamber (not in alignment with the central axial discharge passage).

According to another embodiment of the chamber, said control means are in the form of one or more concentric axisymmetrical inner ribs provided on at least one of the end faces of said chamber and forming thereon inner concentric annular channels.

Preferably, said at least one end face is provided by a plurality of the axisymmetrical concentric inner ribs being arranged in such a manner, that tops of said ribs belong to an axisymmetrical surface with the generatrix being a monotonic line.

The function of the concentric annular ribs may be explained as follows. In a milling whirl chamber having conventional smooth inner surfaces of the end faces, the layers of the rotating fluid flow which come into contact with such surfaces are slightly decelerated, i.e. in these layers the radial centripetal (i.e. directed to the chamber's axis) component of the flow velocity is being increased, while the tangential component of the velocity is being decreased, resulting in that the particles in these layers are gradually drawn in the radial direction towards the axis of the milling chamber, where they are continuously discharged from the chamber via the axial exit passage. However, during such a process some quantity of relatively massive coarse particles (and not only the finely comminuted ones) are discharged from the milling chamber before they reach the desired degree of comminution. It has been found, that the presence of the above-mentioned one or more inner concentric annular ribs changes character of the process taking place near the end faces of the chamber.

More particularly, it has been found by the inventor, that some configurations of the concentric annular ribs may help to prevent the premature discharge from the chamber of such solid particles, which have not reached yet the preselected degree of comminution. However, other configurations of such ribs may have the opposite effect.

Namely, it has been noticed, that duration of the milling process (and consequently, the degree of comminution) may be controlled by adjusting the height of the milling chamber by altering heights of the concentric annular ribs. The term "height (h) of the whirl milling chamber" used herein with reference to the inventive device should be understood as meaning the internal height of the chamber, which is measured at radius r in one of the following ways:

between two axisymmetric surfaces formed by tops of two pluralities of annular ribs placed on two opposite end faces, respectively; or between an axisymmetric surface formed by tops of the annular ribs positioned on one end face, and the opposite end face having no annular ribs.

For example, when the heights of the concentric ribs gradually decrease in the direction from the periphery towards the axis of the chamber, (i.e. when the height "h" of the chamber gradually increases from the periphery to the axis thereof) the degree of comminution in the chamber will be increased, with simultaneous increase of the milling time. Such ribs will prevent the relatively massive particles from the premature discharge, thus retaining thereof in the chamber for a longer time and thereby ensuring more fine and uniform comminution. And vice versa, when each peripheral rib is shorter than a more central one, i.e. when the height "h" of the chamber decreases gradually from the periphery to the axis of the chamber, the vortex will be "contracted" in the central portion of the chamber, thereby enabling to achieve a relatively quick and coarse milling with lower uniformity.

In practice, the height of at least one of the concentric ribs may be adjustable. For example, one or more said axisymmetric concentric ribs may be formed by one or more tubular sections, respectively, being adjustably secured in a base plate; said plate being installed hermetically tight in the chamber in close proximity to one of the end faces of the housing.

It has further been found by the inventor, that parameters of the concentric ribs should preferably be selected according to the formulae substantially close to the following:

$$dm/(r_0-a)\leqq 0.6 \quad (1)$$

where: d—is the thickness of a rib measured in the radial direction;

m—is a number of the ribs on one end face of the chamber;

$r_0$—is the inner radius of the side wall of the chamber;

a—is the radius of the axial passage for discharging the comminuted material.

The physical meaning of the above formula is as follows: when the total thickness of the ribs reaches 60% or more of the working radius of the face end, their influence on the vortex can be neglected.

In the most preferred embodiment of the invention the profile (actually, the generatrix) of the surface, formed by tops of the annular ribs mounted at one said end face of the chamber, may be described by an equation substantially close to the following:

$$h=h_0(r/r_0)^S \quad (2)$$

where: $h_0$—is the internal height of the side wall of the chamber;

$r_0$—is the radius of the side wall of the chamber;

h—is the height of the chamber at radius r;

S—is an index of a power which is defined by formula (3):

$$-2.0\leqq S\leqq(\log_2(r_0/a))^{-1} \quad (3)$$

In general, when "S" is positive, annular ribs are shorter near the side wall of the chamber and longer near its center (in other words, the variable "h" decreases in the direction to the center of the chamber), and, as explained, such a configuration allows to accelerate the milling operation in the chamber and to obtain the milling having rather a moderate degree of grinding and uniformity. When a value of the power "S" turns to be negative, the general configuration and the function of the annular ribs change to the opposite from those described above, i.e. the grinding process will take a longer time and the highest possible degree of comminution and uniformity of the milling may be obtained.

Specific parameters of the annular ribs may be chosen according to requirements imposed upon the degree of comminution, and to properties of the material to be milled. When the milling chamber must be used in another milling regime, the parameters of the concentric annular ribs may be adjusted.

Further, if desired, additional fluid injection nozzles may be provided in the end faces of the chamber for the tangential injection of fluid into one or more of said annular channels, in the direction of the vortex. The additional nozzles will accelerate rotation of the retarded layers of the vortex near the end faces of the chamber, while relatively coarse particles will still be retained in the vortex by the annular inner ribs, for further milling.

According to one particular embodiment of the invention said concentric inner ribs may constitute frusto-conical surfaces diverging towards the interior of the chamber. It has been found, that the annular channels formed between such frusto-conical annular ribs are self-cleaning, i.e. during the comminution process they do not retain thereinside particles of the material, so that there is no need in the above-mentioned additional nozzles.

According to an alternative embodiment of the inventive chamber, said at least one mechanic element is a rotatable plate mounted in close proximity to the inner surface of one of said end faces of the chamber. The plate may be either circular or annular (in case it surrounds the axial discharging passage) and is intended for altering the viscous friction between the vortex and the inner surfaces of the end faces of the chamber. Depending on the direction and the speed of the plate's rotation, it may either prevent the premature discharge of the relatively coarse particles from the chamber, or accelerate it, as the case may be.

It should be appreciated, that the control means of the whirl milling chamber may comprise said at least one rotatable plate and said one or more additional discharge channels. Other combinations are also possible, for example the chamber may be simultaneously provided with the additional discharge channel(s) and said one or more concentric axisymmetrical inner ribs, etc.

In order to further improve the structure of the whirl chamber so as to render it more effective, its specific design may additionally comprise at least one baffle rib positioned on the internal surface of said side wall and having a curved surface with a height gradually increasing in the direction of the vortex rotation. The purpose of introduction the baffle ribs into the whirl chamber is to adjust the direction of the particles moving in the fluid flow close to the side walls of the chamber so, as to periodically diverse thereof towards the center of the chamber. Owing to the baffle ribs the particles which rotate with the flow are caused to be periodically returned from the inner side walls of the chamber to more central trajectories therein and back, and thus to travel continuously in the radial direction from one trajectory to another. As was mentioned above, trajectories having different radii are believed to have different pressure levels owing to what the particles of the particulate material get destroyed in the whirl chamber.

An alternative or an additional way to control the comminution process is to provide the inner wall of the chamber with a source of elastic vibrations of the fluid flow for creating a standing wave in the vortex. The standing wave forms additional gradients of pressure in the chamber, thus contributing to the comminution process of the particles which move in the vortex. The source of elastic vibrations may constitute, for example, a source of sound, or just a means for creating pulsations in the fluid flow. The frequency and the amplitude of the vibrations may be controlled.

BRIEF DESCRIPTION OF THE DRAWINGS

The above invention will be further described and illustrated with reference to the appended non-limiting drawings, in which.

DETAILED DESCRIPTION OF THE PREFERRED EMBODIMENTS

Figure 1:
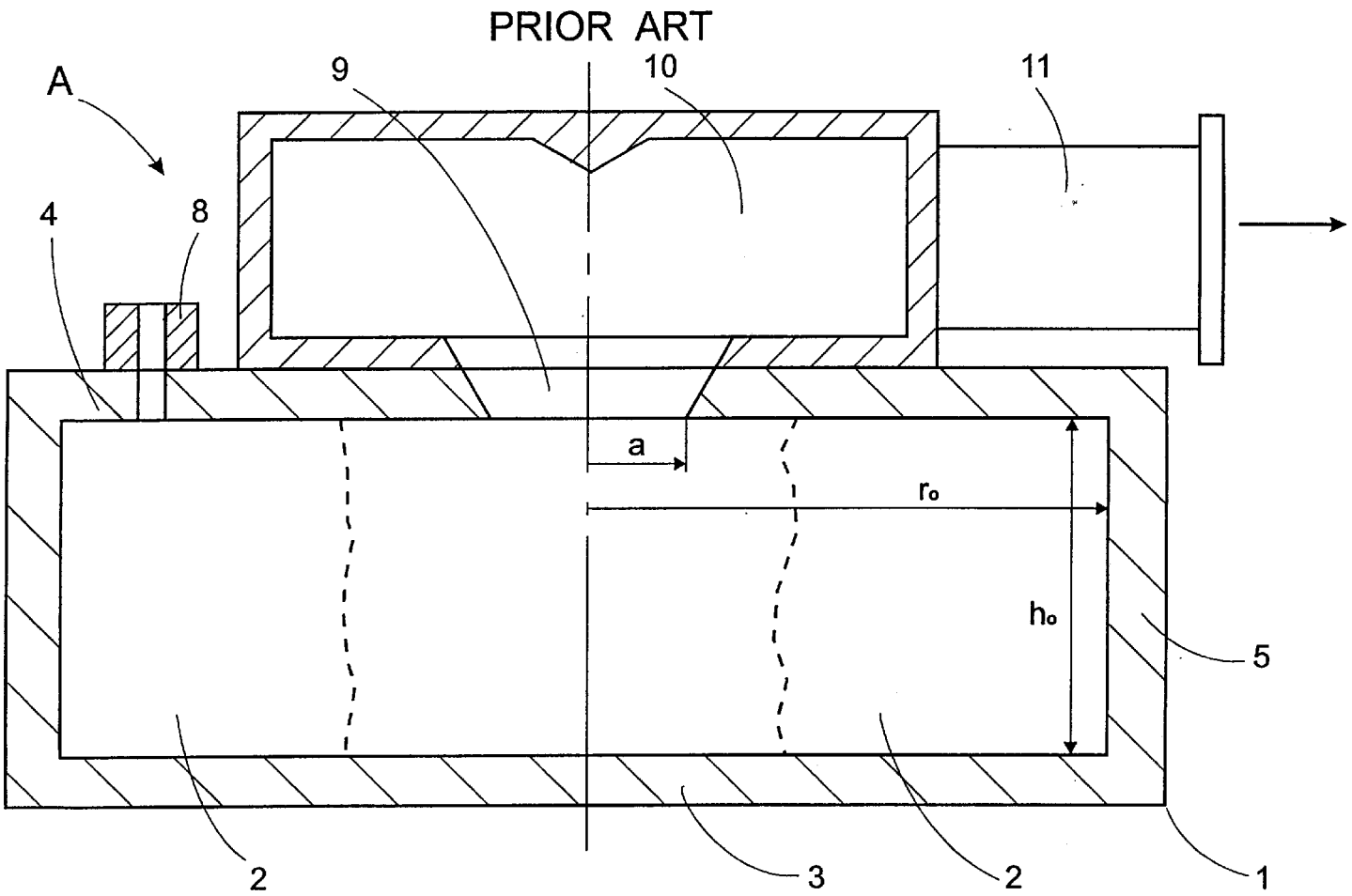
FIG. 1 is a schematic axial cross-sectional view of a conventional whirl milling chamber.
Figure 2:
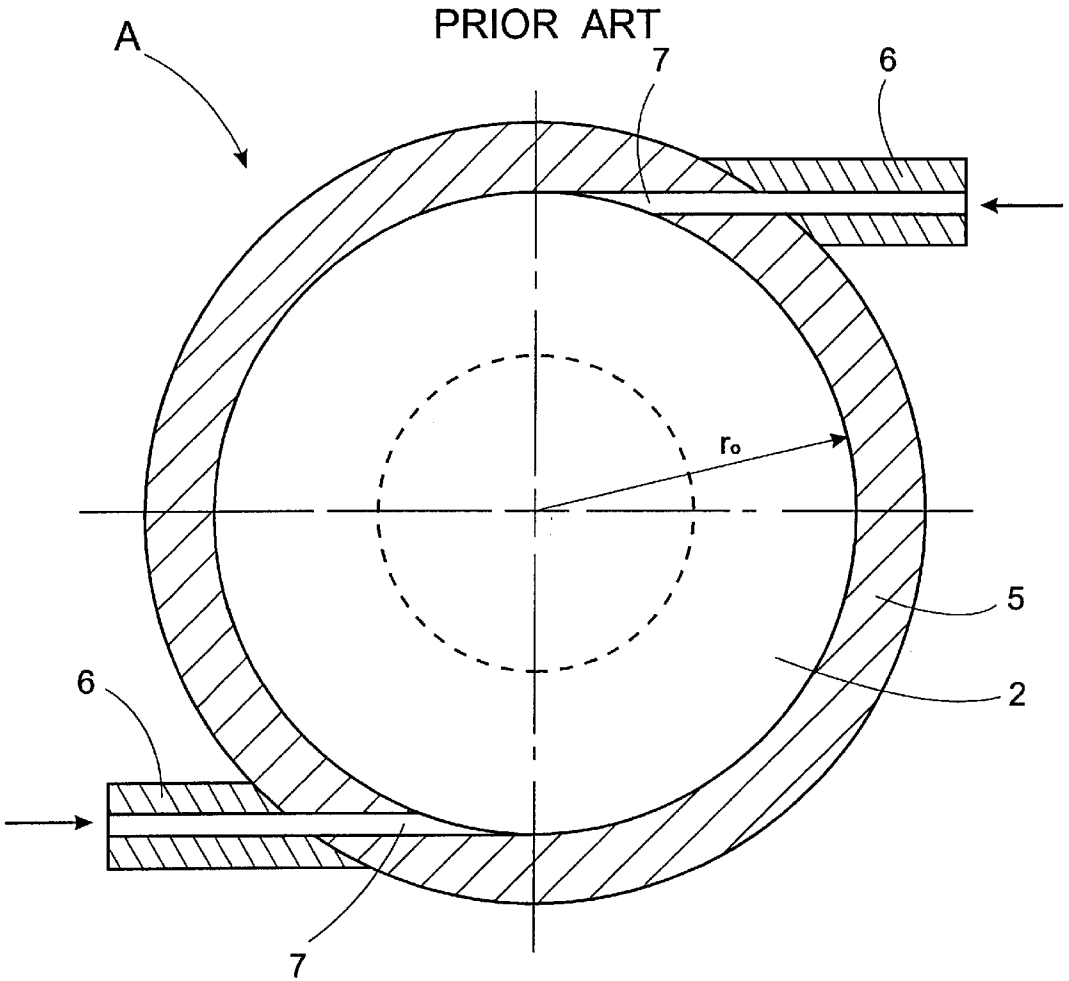
FIG. 2 is a radial cross-sectional view of the conventional whirl milling chamber shown in FIG. 1.

A conventional whirl milling chamber "A" is illustrated diagrammatically in FIG. 1 which is an axial cross-section, and FIG. 2 which is a radial cross-section thereof. As shown, the apparatus comprises a cylindrical body 1, the interior of which constitutes a vortex milling chamber 2. The cylindrical body 1 has a lower face end 3, an upper face end 4 and a side wall 5. The side wall 5 is fitted with a pair of tangential fluid injection ducts 6 terminating each with a nozzle 7. For example, the nozzles may be manufactured in the form of two vertical slots having the height identical to the height "$h_0$" of the inner side wall of the chamber 2. Radius of the milling chamber is marked "$r_0$". A sealable opening 8 serves for the introduction of a particulate solid matter to be comminuted. However, the material may be introduced in a different way, for example—together with the working fluid, via the nozzles 7. An inverted frusto-conical discharge axial passage 9 having the internal radius "a" leads to a collector chamber 10 where the comminuted material accumulates and which is fitted with a discharge duct 11.

During operation of the whirl chamber "A" the smaller milled particles will be caused to gradually approach the central trajectories in the chamber 2 (which are schematically limited in FIGS. 1 and 2 by a broken-lined cylinder) and to be continuously discharged therefrom to the collector chamber 10 via the axial exit passage 9.

Figure 3:
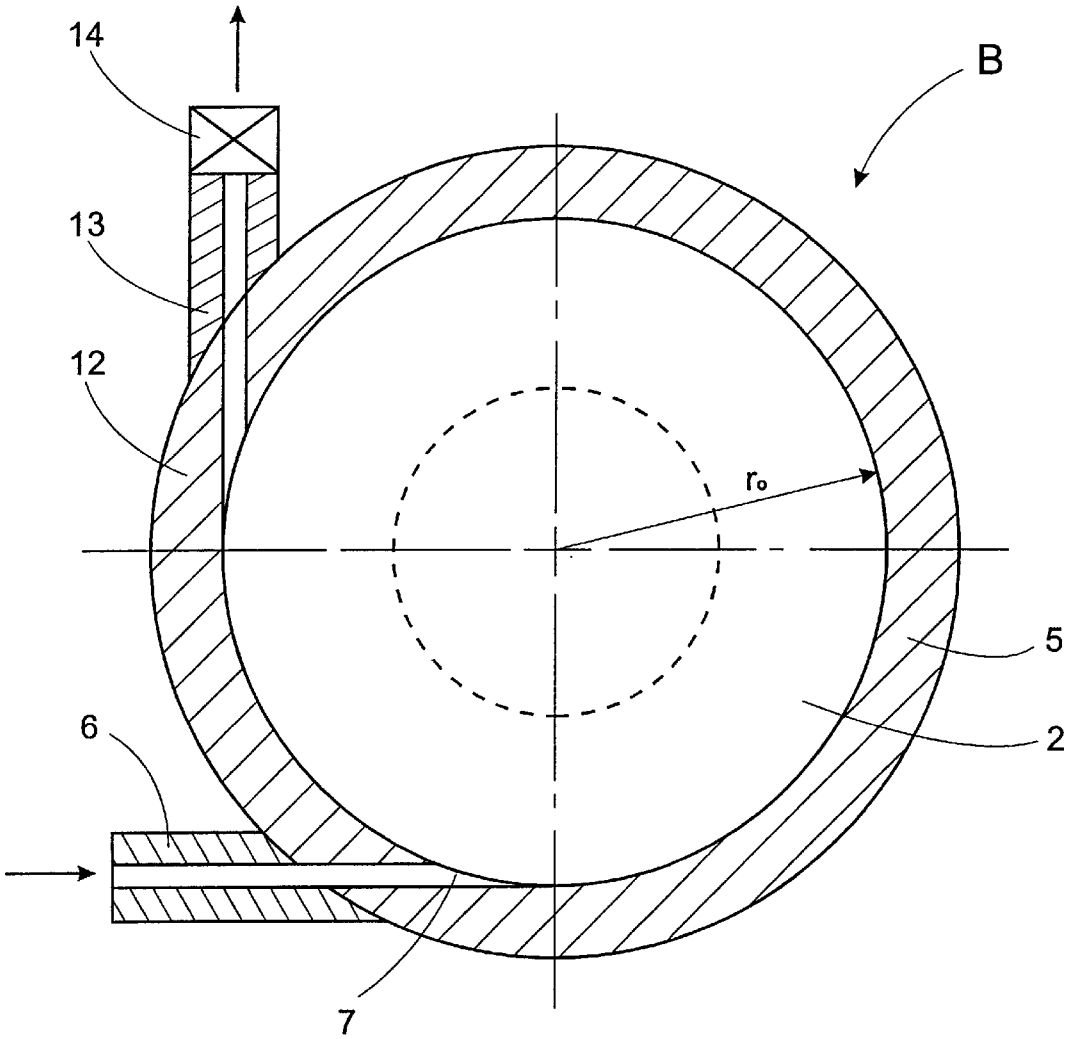
FIG. 3 is one embodiment of a controlled milling whirl chamber according to the invention, provided with an additional discharge channel.

FIG. 3 illustrates a radial cross-sectional view of an embodiment "B" of the whirl milling chamber which is provided with an additional discharge channel 12 serving as control means for altering duration of the comminution process and, consequently, of the parameters of the milling to be obtained. In this particular embodiment the additional channel 12 is provided in the side wall 5 of the chamber and fitted with a tangential discharge duct 13 having a control cock schematically marked 14. When the cock is opened, the working fluid, owing to the pressure difference (since pressure of about 3 atm (abs.) may be created in the chamber), will discharge from the milling chamber 2 the particles moving in the peripheral layers of the vortex. The additional channel 12 and the cock 14 must be designed so that the maximal volumetric flow rate through the duct 13 never exceeds 40% of the total volumetric flow rate created in the vortex in the chamber 2. By effecting a premature discharge of a portion of the material from the vortex via the additional channel 12, one may reduce duration of the comminution process, and thereby also the uniformity of the milling and the range of comminution.

Figure 4:
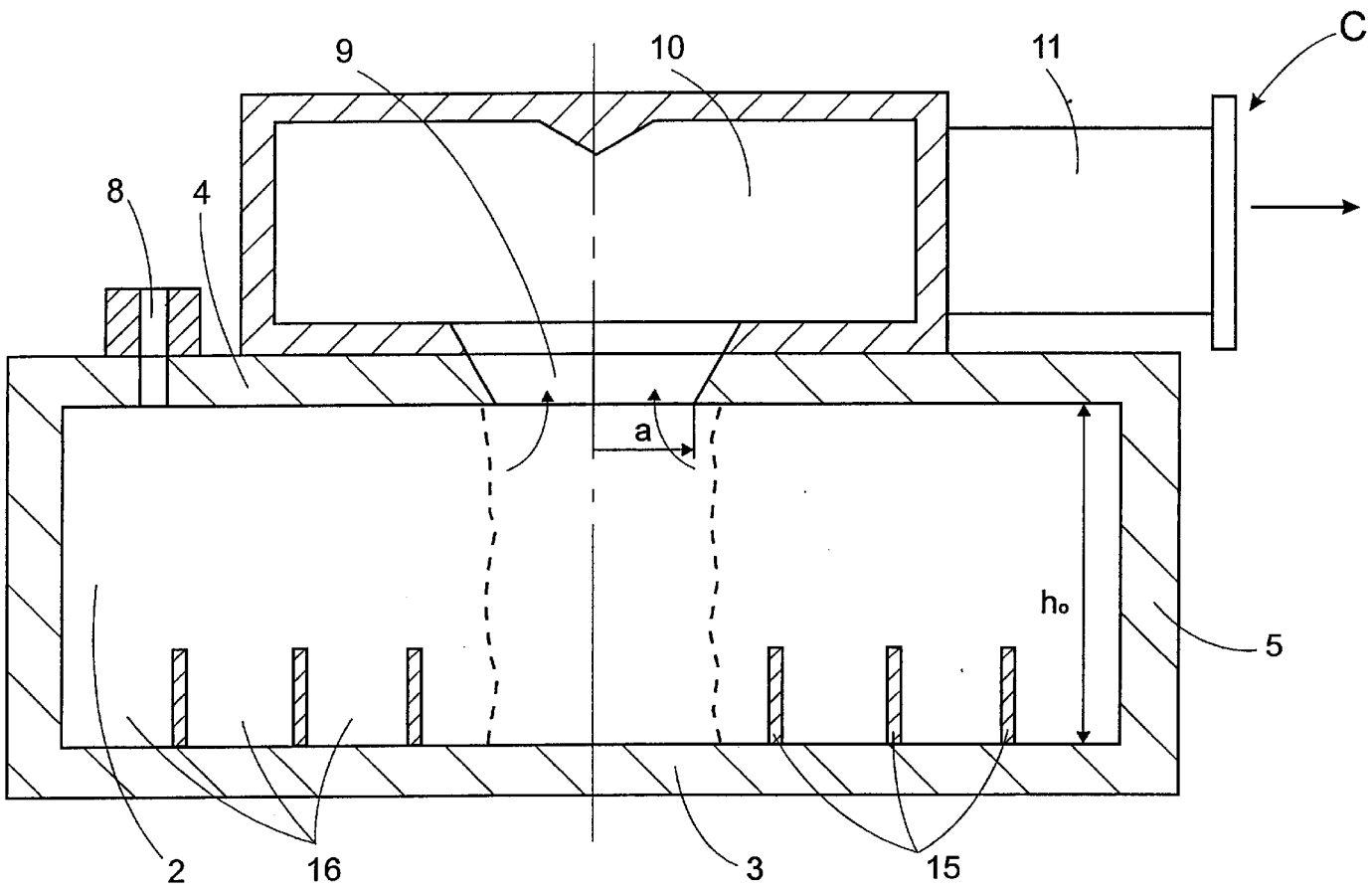
FIG. 4 is a schematic axial cross-sectional view of another embodiment of the controlled whirl milling chamber and comprising concentric annular ribs on one of the inner end faces.
Figure 5:
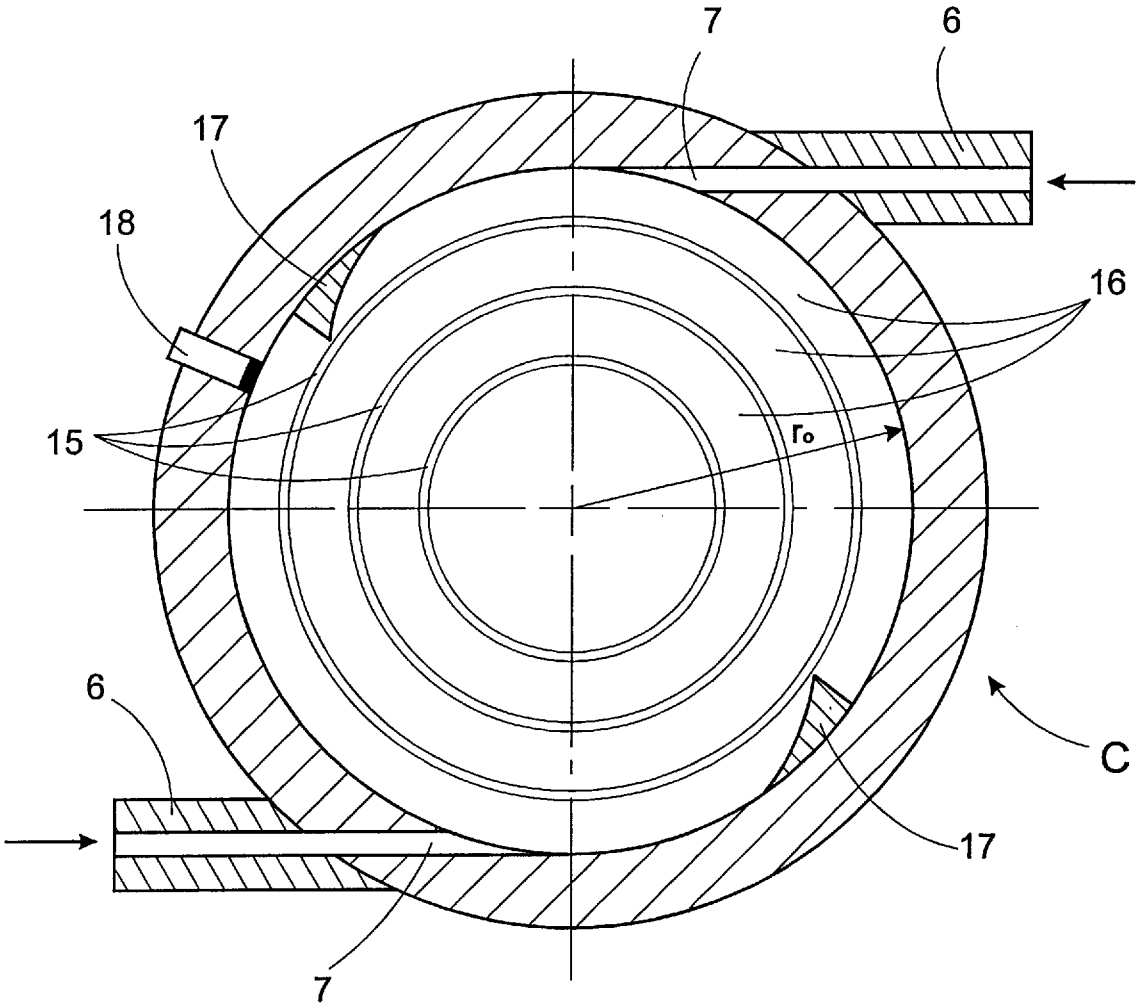
FIG. 5 is a radial cross-sectional view of the controlled whirl milling chamber shown in FIG. 4.

Another embodiment "C" of a controllable whirl milling chamber according to the invention is shown in two drawings, wherein FIG. 4 is an axial cross-sectional view, and FIG. 5 is a radial cross-sectional view of this chamber. The conventional structure of the whirl milling chamber is provided with control means in the form of concentric axisymmetrical inner ribs 15 manufactured on the inner surface of one of the end faces (3) of the chamber, and these ribs form inner concentric annular channels 16 at the end face 3. As was explained above, presence of the annular concentric ribs 15 enables to change the viscous friction of the vortex flow near the end face 3, and in this particular case will result in retaining relatively coarse particles, which move in close proximity to the end face 3, in the vortex for a prolonged time. The increased duration of the comminution process applied to the relatively coarse particles leads to obtaining a fine milling with rather high uniformity.

For more effective milling, the chamber "C" is provided with optional baffle ribs 17 positioned on the inner surface of the side wall 5. Each of the baffle ribs has a curved surface; in this embodiment the ribs are so located that the curved surfaces face the adjacent injection slots 7. On the side wall 5 there is mounted an optional controlled sound generator 18 which also enhances the grinding operation.

Parameters of the concentric inner ribs 15 are selected according to the material to be comminuted and requirements imposed upon the milling to be obtained. The same applies to the number and parameters of the baffle ribs 17, as well as to the frequency and amplitude of the sound generator 18.

Figure 6:
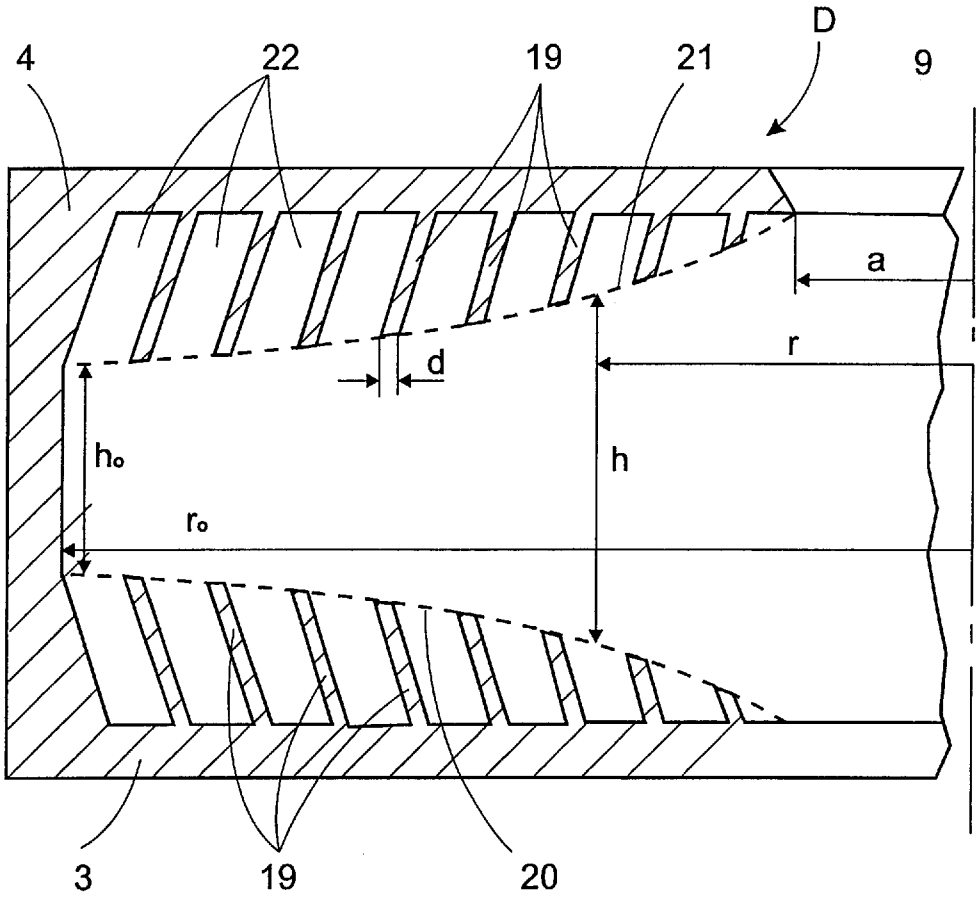
FIG. 6 is a partial cross-sectional axial view of another embodiment of the whirl milling chamber provided on its top and bottom inner end faces with concentric annular ribs having a specific configuration.

FIG. 6 illustrates a partial axial cross-sectional view of yet another embodiment "D" of the whirl chamber, which has two pluralities of concentric ribs 19 manufactured on the inner surfaces of the top (4) and bottom (3) end faces of the chamber 2. It should be emphasized, that any whirl milling chamber described in the present application is able to work in positions different from that illustrated in the drawings, and therefore the terms "a top end face" or "a bottom end face" are used here in connection with the particular example and for the sake of simplicity only. A current value of the variable "h" symbolizing the height of the whirl chamber is measured at a particular radius r between two axisymmetrical surfaces (schematically shown by broken lines 20 and 21) formed each by top edges of the concentric ribs 19 placed on one of the end faces of the chamber. It should be noted, that when only one end face of the whirl chamber is provided with the annular ribs, the height "h" is measured between the surface formed by the tops of the annular ribs 19 and the opposite end face surface. The concentric ribs 19 form therebetween annular concentric passages 22. The concentric ribs serve for retaining in the chamber relatively coarse particles which, if moving in the vortex layers close to the inner surfaces of the end faces, might otherwise be prematurely discharged from the chamber due to their tangential deceleration in the mentioned layers of the vortex. Thickness of the rib is marked "d", the radius of the chamber—"$r_0$", and the height measured at the radius "$r_0$" is marked "$h_0$". The configuration of the surfaces 20, 21 illustrated in this drawing suits to the task when a high degree of milling and a high uniformity of the comminuted particles are required. In such a milling chamber relatively coarse particles are retained in the central layers of the vortex for a longer time, till they reach the required size and mass at which the comminuted fine particles will be discharged from the chamber via the axial discharge passage 9. The frusto-conical shape of the annular concentric ribs 19 flaring out to the interior of the chamber renders the annular channels self-cleaning.

Figure 7:
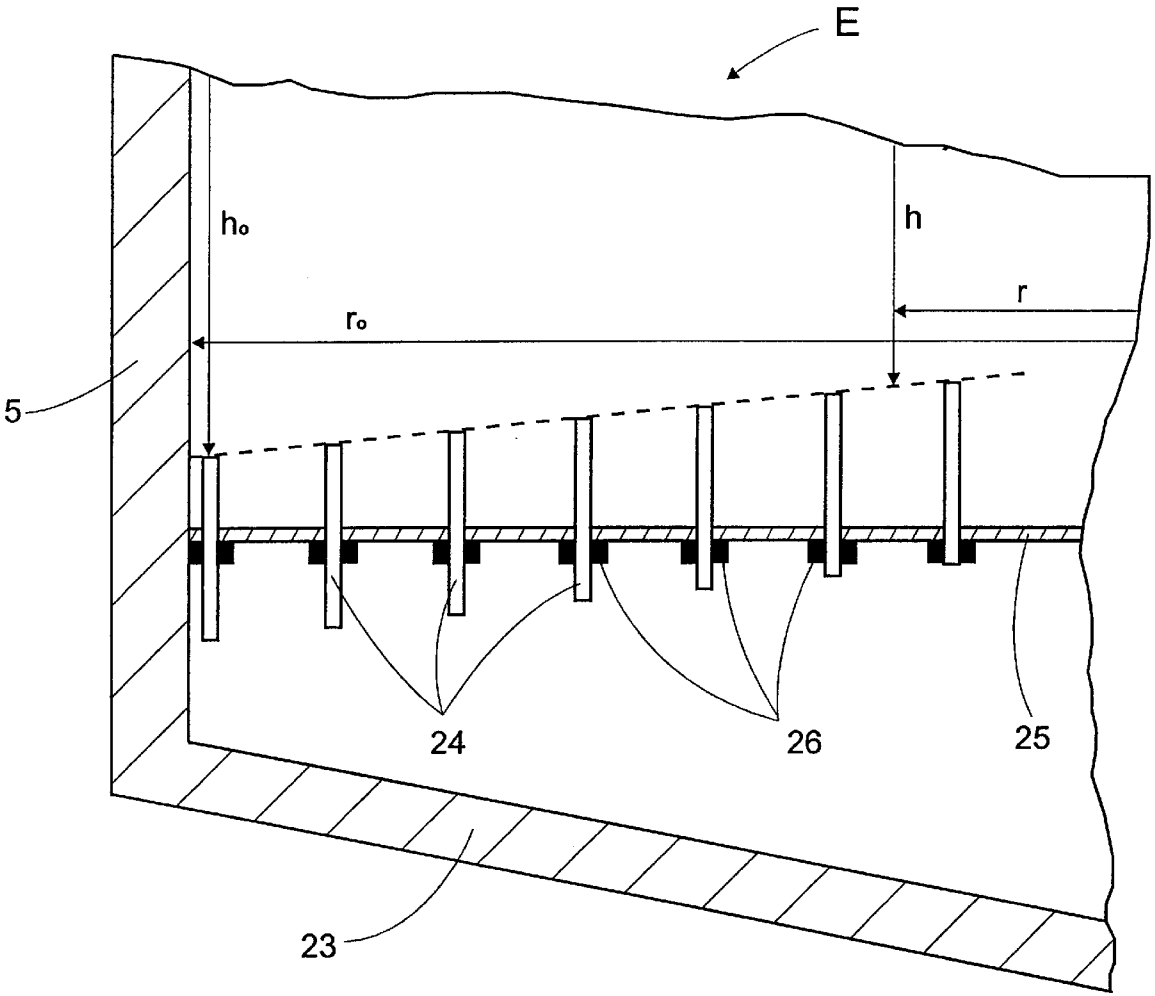
FIG. 7 is a partial axial cross-sectional view of yet another embodiment of the inventive whirl milling chamber having adjustable construction of the concentric annular ribs.

FIG. 7 is a partial cross-sectional view of yet another embodiment "E" of the whirl milling chamber showing its side wall 5 and a bottom end face 23. The discharge axial passage is not shown. In this embodiment the axisymmetrical concentric ribs are formed by sections 24 of cylindrical pipes which are coaxially mounted in a base plate 25 in such a manner, that the height of each of the plates may be adjusted by displacing the sections in the axial direction. The sections 24 are secured in position by holders 26. The base plate 25 is tightly fitted above the bottom end face 23 of the chamber, and its position may also be regulated. The illustrated configuration of the ribs 24 in the chamber "E" (i.e. the shorter ribs at the side wall and the longer ribs at the center) is chosen so as to accelerate the milling operation in the chamber without satisfying high requirements of uniformity of the milling. In other words, the height of the chamber "h" decreases in the direction from the periphery to the center of the chamber. The profile of the surface formed by tops of the ribs 24 is characterized by a positive power "S" (see formula 3). For example, if $r_0/a=5$ (say, $r_0=100$ mm, and a=20 mm), the power will be $S=1/\log_2 5=1/2.32=0.43$. The annular ribs are mounted in such a manner, that their tops form a surface with a generatrix complying to the equation $h=h_0(r/r_0)^{0.43}$. It means, that if in the illustrated whirl chamber $r_0=100$ mm and $h_0=50$ mm, the height of the chamber at radius r will be defined as follows: $h=50(r/100)^{0.43}$ (mm). A working cylindrical surface of the chamber calculated for r=a will be half as large as the working cylindrical surface of the chamber at $r=r_0$. Such a ratio results in so called contraction of the vortex in the central portion of the chamber and thus in acceleration of the discharge.

Figure 8:
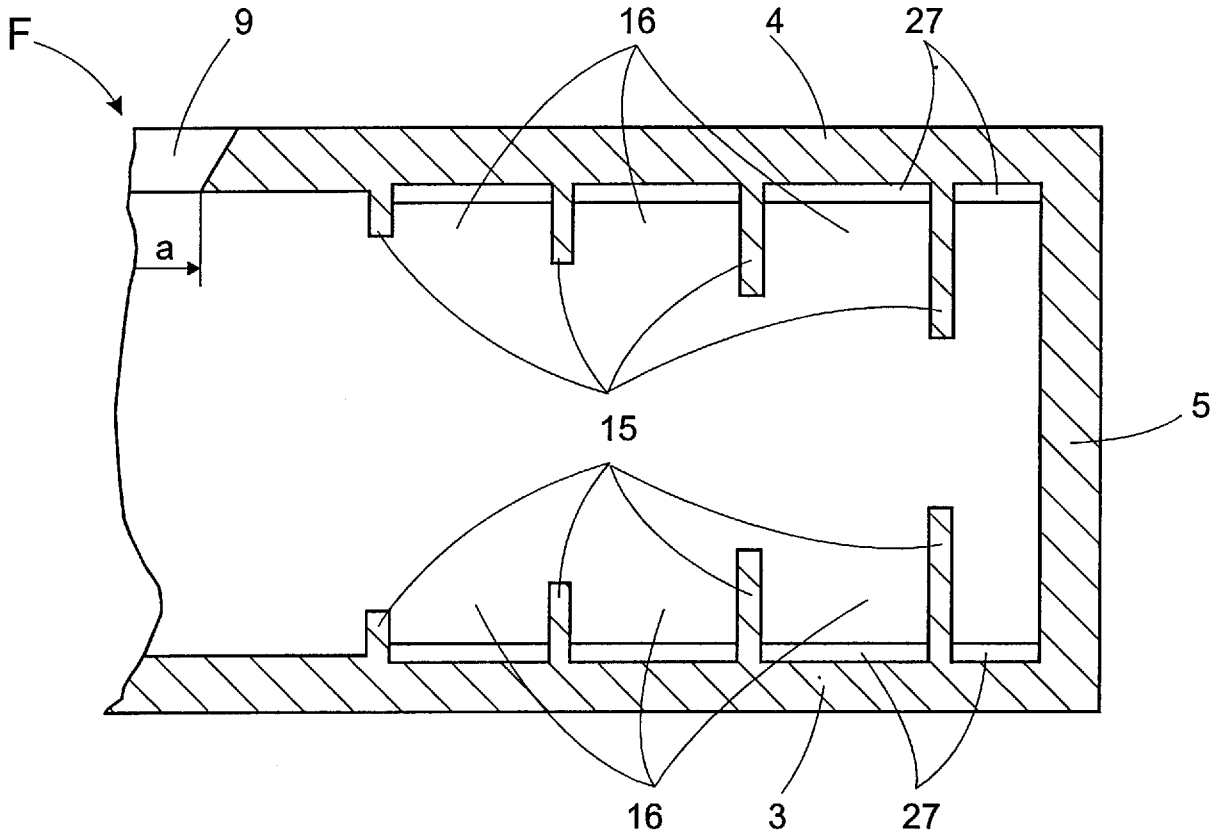
FIG. 8 is a partial axial cross-sectional view of the inventive milling whirl chamber provided with additional nozzles positioned in the annular channels formed by the annular ribs.

FIG. 8 is a partial axial cross-section of a further embodiment "F" of the whirl milling chamber showing two end faces 3 and 4 where additional fluid injection nozzles 27 are arranged between ribs 15. The nozzles 27 provide for tangential injection of the working fluid in the direction of the vortex, i.e. vertically to the plane of the drawing. The supplementary fluid flows which are thus created in the annular channels 16 between the ribs 15 serve for transporting the relatively coarse particles, which have been retained in the annular channels, back to the middle layer of the vortex where the comminution thereof will be continued.

Figure 9:
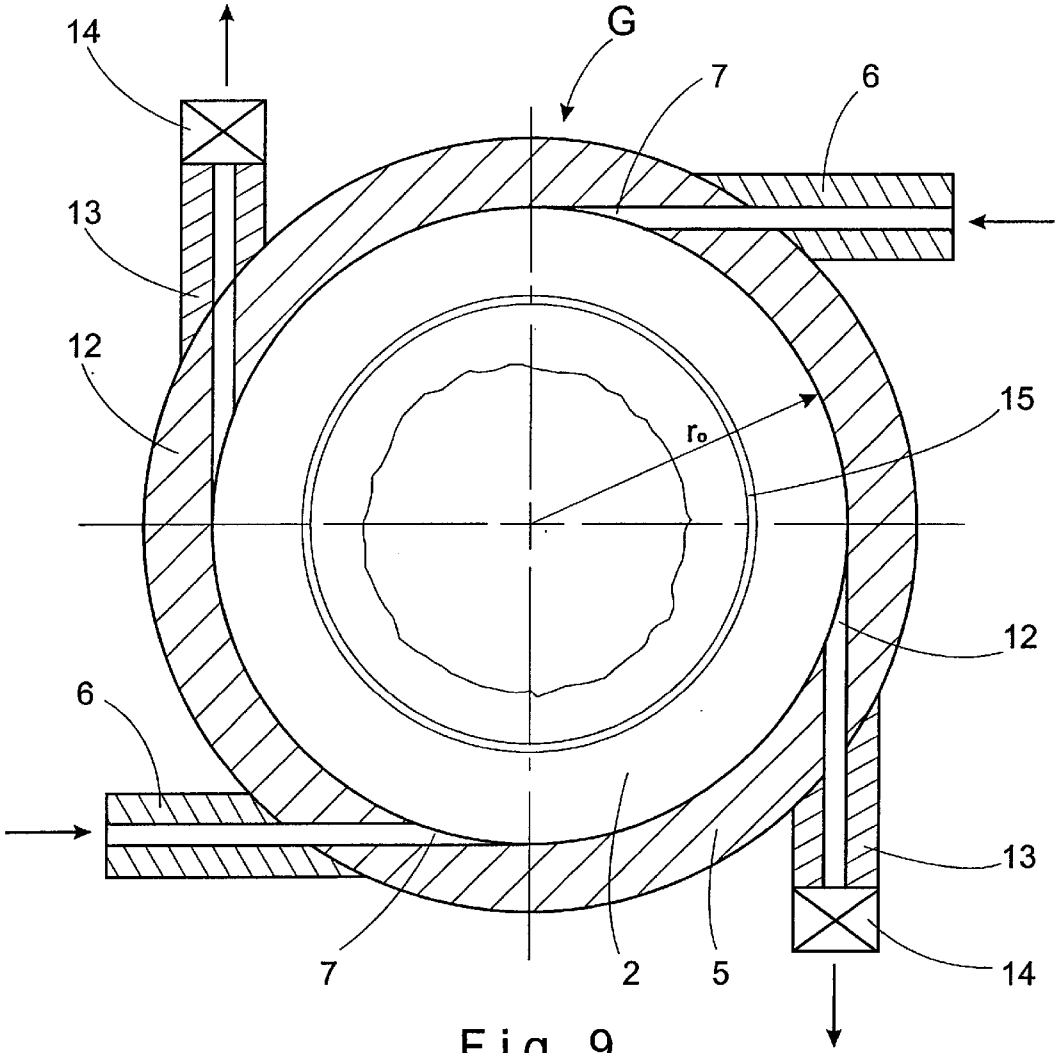
FIG. 9 is a schematic radial cross-sectional view of yet another embodiment of the milling whirl chamber comprising two additional discharge channels and an annular concentric rib on one of the end faces of the chamber.

FIG. 9 illustrates an embodiment "G" of the milling whirl chamber. It comprises two injection nozzles 7 for the working fluid and is provided with control means including two additional discharge channels 12 with tangential ducts 13 and one concentric annular rib 15 provided on one of the end faces of the chamber 2.

Figure 10:
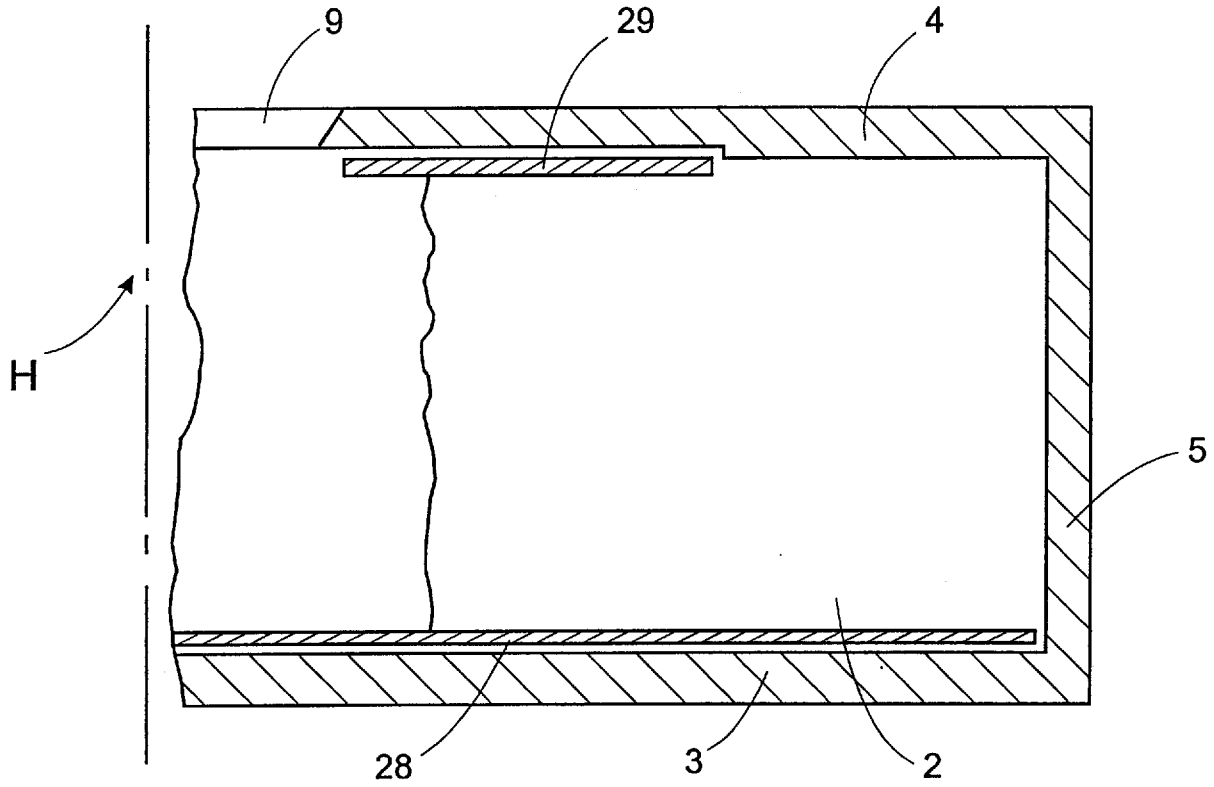
FIG. 10 is a partial axial cross-sectional view of yet another embodiment of the inventive milling chamber comprising two rotatable plates.

FIG. 10 is a partial axial cross-sectional view of yet another embodiment "H" of the inventive milling chamber, which comprises two rotatable plates 28 and 29 mounted in close proximity to the end faces 3 and 4, respectively. The plate 28 is circular; the plate 29 has a ring-like shape and surrounds the axial discharge passage 9. Rotation of the plates 28 and 29 in the direction of the vortex enables to obtain the more uniform and fine milling, and vice versa. Both the direction and the speed of the plates' rotation are adjustable by a control unit (not shown).

Figure 11:
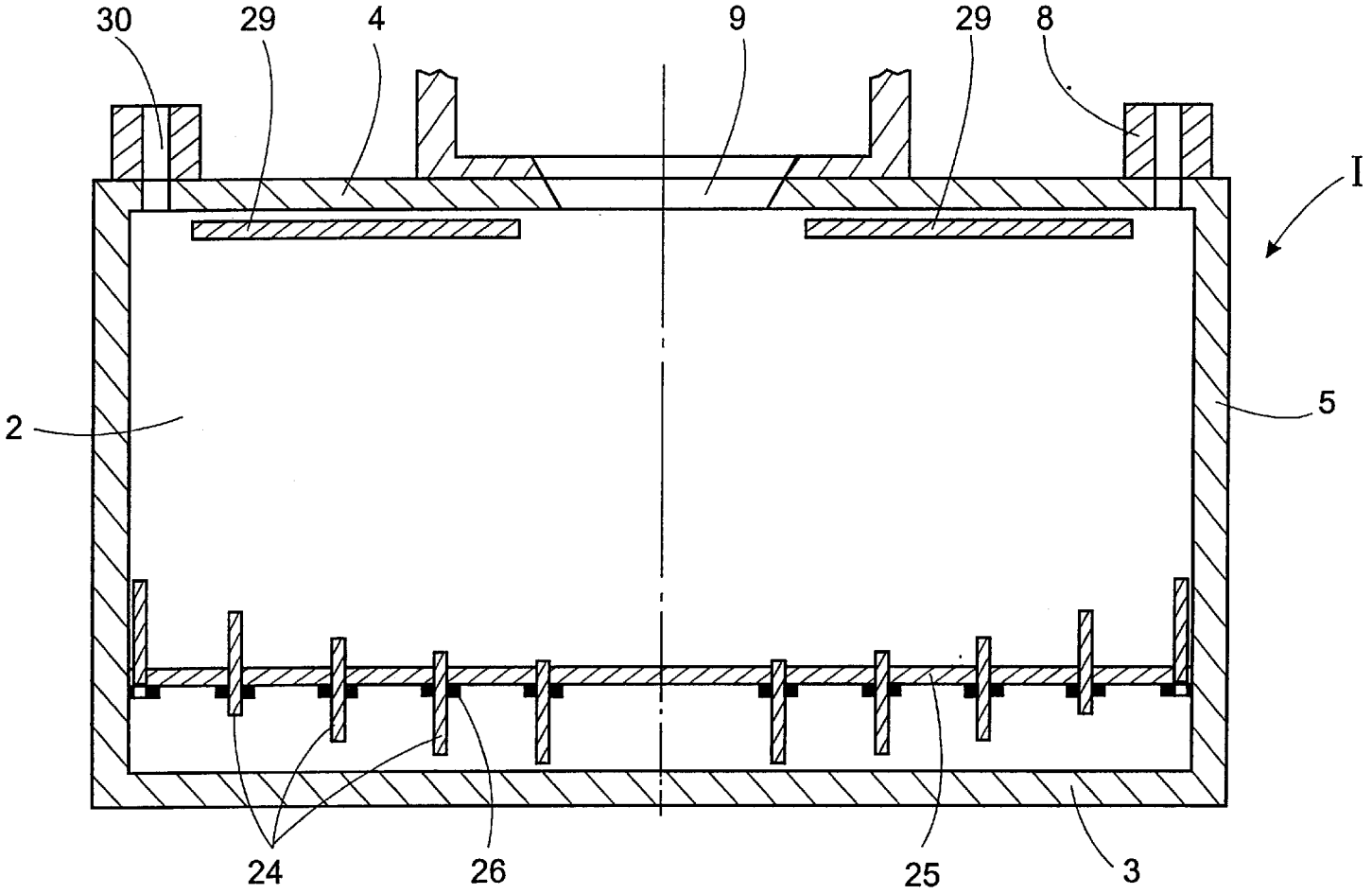
FIG. 11 is a schematic axial cross-sectional view of a further embodiment of the milling whirl chamber comprising one additional discharge channel positioned on one of the end faces, one rotatable plate and a number of annular concentric ribs.

FIG. 11 is a combined embodiment "I" comprising a basic chamber 2 formed by two end faces 3 and 4 and having nozzles for the working fluid injection (not seen), a sealable opening 8 for the introduction of the particulate solid matter, and an axial discharge passage 9. Control means of the whirl milling chamber "I" include one additional discharge channel positioned in the end face 4, a rotatable annular plate 29 mounted on the inner surface of the end face 4, and a plurality of adjustable annular ribs 24 secured on a base plate 25 which is tightly mounted in the chamber so as to cover the inner surface of the end face 3. Parameters of the expected milling may be regulated either by one of the mentioned mechanical elements 30, 29, 24, or by any combination thereof.

EXAMPLE

A conventional whirl chamber of the type shown in FIGS. 1 and 2 and the whirl chamber according to the invention were used for comminution of sand. The volumetric flow rate in both of the whirl chambers was maintained at 2500 liters/min, the pressure of the incoming flow was maintained at 2.8 atm. The sand comprised 94% of $SiO_2$ and was sorted through a grid having meshes of 710 microns. The obtained results are accumulated in the attached Table 1.

The first line of the table comprises characteristics of the milling obtained in the conventional whirl chamber (as shown in FIGS. 1 and 2).

In the second line of the table there are indicated characteristics of the powder obtained in the whirl chamber with an additional discharge channel (see FIG. 3), when 10% of the working flow is discharged therethrough.

The third line reflects results of the comminution performed by the same chamber (as shown in FIG. 3), when 20% of the working flow is discharged through the additional channel. One may notice, that the powder of the third line is "coarser" and less uniform, than that of the second line.

The fourth, fifth and sixth lines of the Table 1 reflect results which were obtained when using the whirl chamber with axisymmetric concentric cylindrical inner ribs and a rotatable plate (i.e. the chamber one embodiment of which is shown in FIG. 11). Rotation of the plate was free and its velocity was defined by the viscous friction of the vortex.

The fourth line comprises parameters of the powder obtained in the chamber where the cylindrical inner ribs had equal heights (similar to those illustrated in FIG. 4, i.e. s=0).

The fifth line reflects results of the comminution in the whirl chamber where the concentric ribs gradually decrease in height from the periphery to the center (similar to those shown in FIG. 11; s=−1).

The sixth line comprises features of the milling obtained in the chamber where the concentric ribs gradually increased in height from the periphery to the center (similar to that shown in FIG. 7; s=0.4).

As can be summarized from the table, uniformity of the milling may be substantially increased by introducing concentric inner ribs in the whirl chamber. It can further be seen, that configuration of the ribs has a visible effect on the range of comminution. One may notice, that the finest milling was obtained in the whirl chamber where the concentric ribs lowered to the center (line 5 of Table 1). It is interesting to note, that in the chamber with the concentric ribs having the opposite configuration (see line 6 of Table 1) the average size of the obtained particles was even greater than of those obtained in the conventional whirl chamber (line 1 of Table 1).

TABLE 1

| Number | Median particle size (50%), microns | Finer than 2 microns | Top cut (97%), microns | Particle distribution Half-width |
|---|---|---|---|---|
| 1 | 7 | 15% | 17 | between 4 and 10 microns |
| 2 | 10 | 11.50% | 19 | between 6 and 15 microns |
| 3 | 12 | 9% | 24 | between 7 and 18 microns |
| 4 | 5 | 20% | 12 | between 3 and 8 microns |
| 5 | 3 | 30% | 10 | between 1 and 6 microns |
| 6 | 10 | 8% | 20 | between 7 and 13 microns |

I claim:

1. A process of comminution of a particulate solid material, to be effected in a generally cylindrical milling whirl chamber having two end faces and a side wall with at least one nozzle for injecting a working fluid into the chamber, means for introducing the particulate solid material into the chamber, and a central axial passage for discharge of the comminuted material in a flow of the working fluid from the chamber, said process comprising:

tangentially injecting the working fluid in to the chamber, introducing said particulate solid material into the chamber, thereby creating a vortex of the particulate material in the working fluid where said material undergoes comminution, and controlling uniformity of the comminution and dimensions of the comminuted particles by accelerating or retarding discharge from said chamber of the particles moving in the vortex close to inner walls of the chamber.

2. The process according to claim 1, wherein the controlling is accomplished by providing an auxiliary discharge of the particles undergoing comminution via at least one additional discharge channel provided in the chamber and being different from said axial passage; a volumetric flow rate taking place through said at least one channel not exceeding 40% of a total volumetric flow rate in the vortex.

3. The process according to claim 1, wherein said controlling is provided by adjusting conditions of viscous friction between the vortex and the inner surface of the end faces of the cylindrical chamber.

4. A whirl milling chamber for fine comminution of a particulate solid material, having a substantially cylindrical shape with two end faces and a side wall provided with one or more tangential nozzles for the injection of a working fluid into the chamber and creating a vortex therein, said chamber comprising means for the introduction a particulate solid material to be comminuted, an axially disposed discharge passage provided in one or both said end faces, and comminution control means in the form of one or more mechanical elements adapted to interact, when the vortex is created, with the particles moving close to inner walls of the chamber.

5. The chamber according to claim 4, wherein said mechanical element is at least one additional discharge channel provided in said chamber not in alignment with said axially disposed discharge passage and fitted with a control valve, said at least one additional discharge channel being designed so that the maximal volumetric flow rate taking place therethrough does not exceed 40% of a total volumetric flow rate in the vortex.

6. The chamber according to claim 5, wherein said at least one additional discharge channel is provided in the side wall of the chamber and is fitted with a tangential duct for controllable discharge of the material in the direction opposite to that of the vortex.

7. The chamber according to claim 5, wherein said at least one additional discharge channel is provided in one of the end faces of the chamber.

8. The chamber according to claim 4, wherein said control means comprise one or more concentric axisymmetrical inner ribs provided on at least one of the end faces of said chamber and forming thereon inner concentric annular channels.

9. The chamber according to claim 8, wherein said at least one end face is provided by a plurality of said axisymmetrical concentric inner ribs being arranged so, that tops of said ribs belong to an axisymmetrical surface with the generatrix being a monotonic line.

10. The chamber according to claim 9, wherein said concentric inner ribs are of different heights.

11. The chamber according to claim 10, wherein the heights of said concentric inner ribs gradually decrease in the direction from the periphery towards the axis of the chamber, thereby enabling for the increased degree and uniformity of the comminution.

12. The chamber according to claim 10, wherein the heights of said concentric inner ribs gradually increase from the peripheral to the axis of the chamber, thus providing for a relatively quick and coarse comminution with lower uniformity.

13. The chamber according to claim 8, wherein the height of at least one of said concentric ribs is adjustable.

14. The chamber according to claim 13, wherein the concentric ribs associated with a particular end face of the chamber are formed by one or more tubular sections, respectively, being adjustably secured in a base plate; said base plate being installed hermetically tight in the chamber in close proximity to the particular end face of the chamber.

15. The chamber according to claim 8, wherein parameters of said concentric ribs are selected according to the following formula:

$$dm/(r_0-a)\leqq 0.6$$

where: d—is the thickness of a rib measured in the radial direction;

m—is a number of the ribs on one end face of the chamber;

$r_0$—is the inner radius of the side wall of the chamber;

a—is the radius of the axial passage for discharging the comminuted material.

16. The chamber according to claim 9, wherein the generatrix of said axisymmetric surface is described by the following equation:

$$h=h_0(r/r_0)^S$$

where: $h_0$—is the internal height of the side wall of the chamber;

$r_0$—is the radius of the side wall of the chamber;

h—is the height of the chamber at radius r;

S—is an index of a power which is defined by:

$$-2.0\leqq S\leqq(\log_2(r_0/a))^{-1}.$$

17. The chamber according to claim 8, wherein additional fluid injection nozzles are provided in the end faces of the chamber for the tangential injection of the working fluid into one or more of said annular channels, in the direction of the vortex.

18. The chamber according to claim 8, wherein said concentric inner ribs constitute frusto-conical surfaces diverging towards the interior of the chamber.

19. The chamber according to claim 4, wherein said comminution control means comprise one or two rotatable plates mounted in close proximity to the inner surface of one or both of said end faces of the chamber, respectively, for altering the viscous friction between the vortex and the inner surface of the end face of the chamber.

20. The chamber according to claim 4, wherein said comminution control means comprise at least one baffle rib positioned on the internal surface of said side wall and having a curved surface with a height gradually increasing in the direction of the vortex rotation.

21. The chamber according to claim 4, comprising a controllable source of elastic vibrations of the fluid flow for creating a standing wave in the vortex and installed on the inner wall of the chamber.

* * * * *

UNITED STATES PATENT AND TRADEMARK OFFICE

CERTIFICATE OF CORRRECTION

PATENT NO. : 5,855,326
DATED : January 5, 1999
INVENTOR(S) : Beliavsky It is certified that error appears in the above-identified patent and that said Letters Patent is hereby corrected as shown below:

On the title page insert item [56]

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 4 | 2 | 8 | 0 | 6 | 6 | 4 | 07/28/91 | Jackson et al. | | | |
| | | 2 | 6 | 9 | 0 | 8 | 8 | 0 | 10/05/54 | Chatelain | | | |
| | | | | | | | | | | | | | |

UNITED STATES PATENT AND TRADEMARK OFFICE

CERTIFICATE OF CORRRECTION

PATENT NO. : 5,855,326
DATED : January 5, 1999
INVENTOR(S) : Beliavsky It is certified that error appears in the above-identified patent and that said Letters Patent is hereby corrected as shown below:

On the title page insert item [56]

FOREIGN PATENT DOCUMENTS

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | WO | 97 | 3 | 2 | 6 | 6 | 8 | 09/12/97 | PCT | | | | |
| | | WO | 97 | 0 | 7 | 8 | 9 | 2 | 03/06/97 | PCT | | | | |
| | | 2 | 1 | 0 | 3 | 1 | 4 | 2 | 04/07/72 | France | | | | |
| | | | | | | | | | | | | | | |

Signed and Sealed this

Sixth Day of April, 1999

*Attest:*

*Attesting Officer*

Q. TODD DICKINSON

*Acting Commissioner of Patents and Trademarks*